United States Patent [19]

Teagan

[11] Patent Number: 4,474,018

[45] Date of Patent: Oct. 2, 1984

[54] HEAT PUMP SYSTEM FOR PRODUCTION OF DOMESTIC HOT WATER

[75] Inventor: W. Peter Teagan, Acton, Mass.

[73] Assignee: Arthur D. Little, Inc., Cambridge, Mass.

[21] Appl. No.: 375,564

[22] Filed: May 6, 1982

[51] Int. Cl.[3] ..... F25B 7/00

[52] U.S. Cl. ..... 62/79; 62/183; 62/238.6; 237/2 B

[58] Field of Search ..... 62/238.6, 510, 183, 62/79, 238.7; 237/2 B

[56] References Cited

U.S. PATENT DOCUMENTS

| | | | |
|---|---|---|---|
| 2,095,017 | 10/1937 | Wilkes et al. . | |
| 2,375,157 | 5/1945 | Wilkes et al. . | |
| 2,463,881 | 3/1949 | Kemler | 62/510 X |
| 2,497,450 | 2/1950 | Gygax | 62/510 X |
| 2,516,093 | 7/1950 | Ruff | 62/506 X |
| 2,619,326 | 11/1952 | McLenegan | 237/2 B X |
| 2,696,085 | 12/1954 | Ruff | 62/238.6 X |
| 3,301,002 | 1/1967 | McGrath | 62/510 |
| 3,357,199 | 12/1967 | Harnish | 62/183 X |
| 3,885,938 | 5/1975 | Ordonez | 62/510 X |
| 3,916,638 | 11/1975 | Schmidt . | |
| 4,055,963 | 11/1977 | Shoji et al. | 62/238.6 |
| 4,086,072 | 4/1978 | Shaw | 62/510 X |
| 4,089,186 | 5/1978 | Rojey et al. . | |
| 4,098,092 | 7/1978 | Singh | 62/238.6 |
| 4,104,890 | 8/1978 | Iwasaki . | |
| 4,157,649 | 6/1979 | Bussjager et al. . | |
| 4,299,098 | 11/1981 | Derosier | 62/238.6 |
| 4,321,797 | 3/1982 | Yaeger et al. | 62/238.6 X |
| 4,325,226 | 4/1982 | Schaeffer | 62/238.6 |

*Primary Examiner*—Lloyd L. King

*Attorney, Agent, or Firm*—Richard J. Hammond

[57] ABSTRACT

In a heat pump system for domestic hot water, a compressor section 18 provides working fluid at a multiplicity of pressures. Multiple condensers 12, 14 are arranged so that higher pressure working fluid is in heat exchange relationship with higher temperature water. Upon leaving the condensers 12, 14, working fluid is independently expanded and then combined, and it runs through a single evaporator 31 before returning to the compressor 18. The water may be circulated past an external condenser 12, 14 or the condensers 46, 48 may be immersed in a hot water storage tank 38.

15 Claims, 6 Drawing Figures

HEAT PUMP SYSTEM FOR PRODUCTION OF DOMESTIC HOT WATER

DESCRIPTION

Technical Field

This invention relates to heat pumps and is particularly useful in heating domestic hot water.

Background of the Invention

Heat pump systems have been used extensively for many years both in space heating systems and in refrigeration systems. The heat pump has not compared favorably with other heating means where the heated medium is consumed, and thus must often be heated from ambient temperature, or where a high final temperature is desired. An example of the former application is domestic hot water generation. In recent years, however, with a less rapid increase in the cost of electricity, interest in using heat pumps for domestic hot water heating and similar applications has increased.

In a typical heat pump system for heating water, working fluid enters a compressor as slightly superheated vapor at low pressure. After being compressed, and thus being heated, the working fluid leaves the compressor and enters a condenser as a vapor at some elevated pressure. The working fluid is there condensed as a result of heat transfer to water surrounding the condenser tubes and leaves the condenser as a high pressure liquid. The pressure and temperature of the liquid is decreased as it flows through an expansion valve and, as a result, some of the liquid flashes into vapor. The remaining liquid, now at low pressure and temperature, is vaporized in an evaporator as a result of heat transfer from ambient air, a low temperature heat source. This vapor then returns to the compressor.

The central problem in using heat pumps for domestic hot water is that heat pump efficiency is best when the temperature gradient between the low temperature heat source and the temperature of the fluid to be heated is minimized. It has been suggested in U.S. Pat. No. 2,463,881 to Kemler that multiple evaporators and multiple condensers be used to condition room air temperature; however, the complex systems devised suffer serious thermodynamic and structural complications. A Kemler type heat pump system requires a large initial investment, and it is questionable whether it increases efficiency to the extent necessary to ecomonically heat water to domestic hot water temperatures or hotter.

In a heat pump system used for production of domestic hot water, the ambient air used for the low temperature heat source may be 40°, 50°, or 60° for a large part of the year while the desired hot water temperature is roughly 140° F. Typical conventional heat pumps are economically uncompetitive with fossil fuel heat sources and electric heat at temperature gradients greater than 50°–70° F.

An object of this invention is to provide a heat pump system which operates with greater efficiency in heating a heat storage medium such as water, so that it is a practical system for heating domestic hot water or for high temperature applications where the temperature of the heated medium is as high as 160° to 200° F.

Disclosure of the Invention

A heat pump system for heating a heat storage medium has a working fluid which enters a compressor section as a vapor at low pressure. The working fluid leaves the compressor section at multiple, distinct pressure levels and enters multiple condensers. There the working fluid condenses as a result of heat transfer to the heat storage medium, thus warming the heat storage medium. The condensers and the heat storage medium are arranged with higher pressure working fluid in heat exchange relationship with higher temperature heat storage medium. The working fluid then goes through expanders at the outputs of respective condensers and returns to a single pressure. The working fluid vaporizes on passing through an evaporator and returns to the compressor section.

A preferred embodiment of the invention is one in which the heat storage medium is domestic hot water. The water is circulated from a hot water storage tank past the condensers and back to the water storage tank by means of an electric pump.

A second embodiment of the invention is one in which the multiple condensers are immersed in a water storage tank. The fluid storage tank has enhanced water stratification by means of a physical barrier or baffles. In this embodiment, the higher pressure condenser is immersed near the top of the tank so that it is in a heat exchange relationship with the higher temperature heat storage medium.

The multiple distinct working fluid pressure levels may be provided by multiple compressors, a single multiple stage compressor or a single compressor which is ported or bled to provide different pressure levels. Preferably, the working fluid, on leaving the multiple condensers, is expanded to a single stream at a single pressure and goes through a single evaporator before returning to the compressor.

BRIEF DESCRIPTION OF THE DRAWINGS

The foregoing and other objects, features and advantages of the invention will be apparent from the following more particular description of the preferred embodiments of the invention as illustrated in the accompanying drawings in which like reference characters refer to the same parts throughout the different views. The drawings are not necessarily to scale, emphasis instead being placed upon clearly illustrating the principles of the invention.

DETAILED DESCRIPTION OF PREFERRED EMBODIMENTS OF THIS INVENTION

Figure 1:
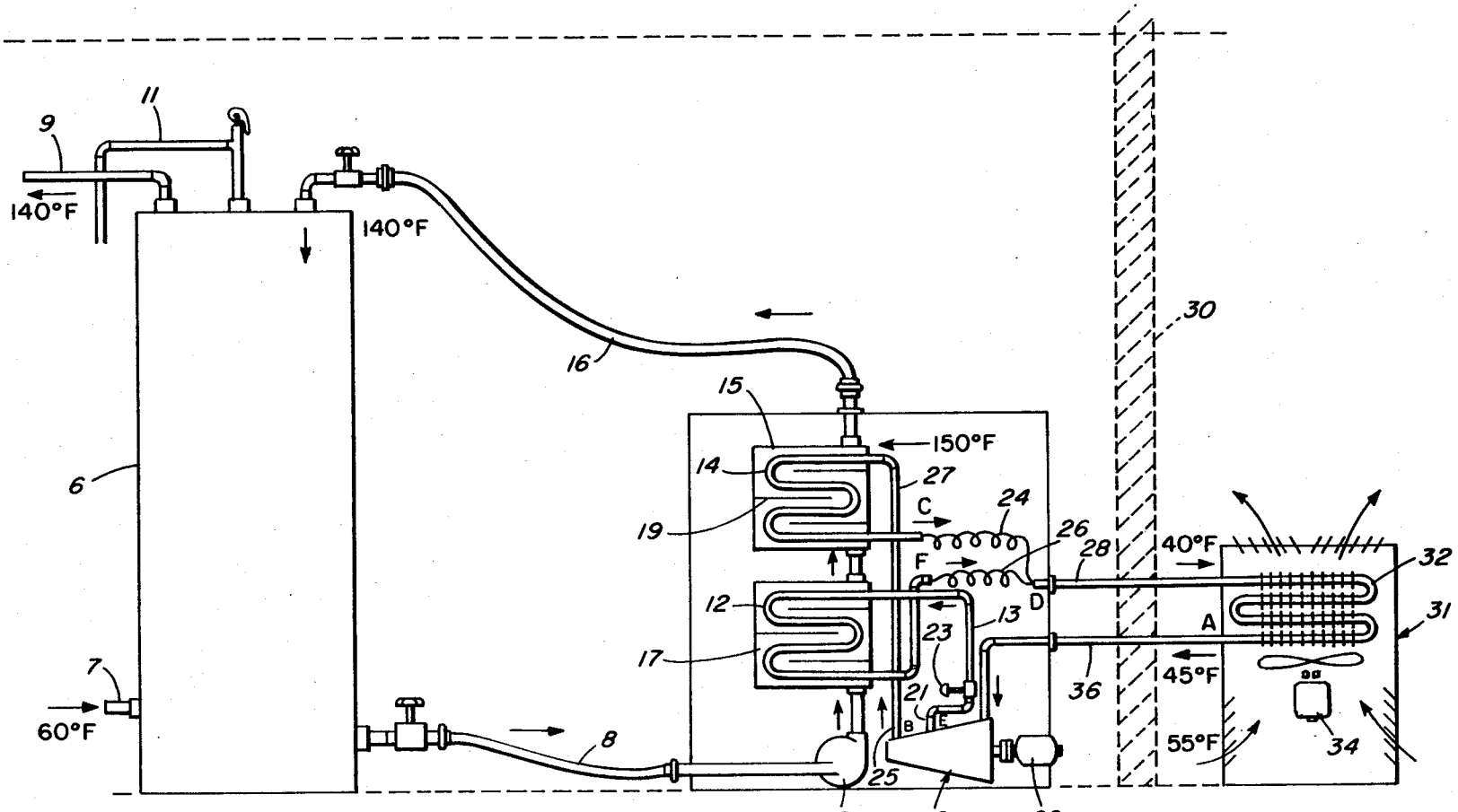
FIG. 1 is a schematic view of a heat pump system, designed to produce domestic hot water, having multiple condensers and embodying this invention.

As shown in FIG. 1, hot water is stored in a conventional hot water tank 6 which is generally located in the basement or on the first floor of a building. Water is supplied to the tank by the cold water inlet 7 and hot water is removed from the tank by the hot water outlet 9. As is typical for any water tank, the warm water tends towards the top of the tank and cold towards the bottom. A standard pressure temperature relief valve and overflow pipe 11 is provided for the hot water tank so as to prevent excessive temperature or pressure.

Water from the tank 6 is circulated through outlet 8 and water circulation pump 10, past two heat pump condensers 12 and 14 which heat the water. The heat pump condensers in this embodiment are counterflow heat exchangers in which the water flows through water jackets 15 and 17 and is directed by baffles 19. The condensers heat the water by transferring energy released by a high temperature condensing vapor to the water. The heated water is then returned to the top of the tank 6 via pipe 16. In this way the heat pump supplies a continuing or intermittent flow of hot water to the hot water storage tank as required by domestic needs. The hot water from the outlet 9 is provided on demand to any number of taps and the like throughout the building or residence.

The domestic hot water is heated by a heat pump embodying this invention. A heat pump is a means for delivering heat energy by driving a working fluid pneumatically through its vapor and liquid states. In accordance with the present invention the working fluid is supplied either to a two-stage compressor section or a single stage compressor 18 with an intermediate pressure bleed port 21 as shown. The compressor section driven by motor 22 serves to compress the working fluid and thereby drive it to higher pressures and temperatures. In this embodiment some of the working fluid is driven to an intermediate pressure at intermediate bleed port 21, while the rest of the fluid is driven to the high pressure port 25 of the compressor 18. The amount of working fluid to be driven to the higher pressure is determined by valve 23. The intermediate pressure working fluid is in a superheated vapor state and that which is not further compressed is routed along pipe 13 into the low pressure condenser 12. In the condenser, the superheated vapor gives up heat to the surrounding water jacket being fed from the hot water tank 6 by the pump 10. The working fluid thereby ceases to be a superheated vapor and condenses into a pressurized liquid state.

The high pressure working fluid, which is also a superheated vapor, leaves the high pressure port 25 of the compressor along pipe 27 and enters the high pressure condenser 14. As the high pressure working fluid condenses to a pressurized liquid, it further raises the temperature of the water in the hot water jacket 15. That water is then returned to the hot water tank.

The working fluid, on leaving the condensers, is expanded through capillary tubes 24 and 26 to a uniform pressure and returns to a single stream in pipe 28. The working fluid in pipe 28 consists of a mixture of vapor and liquid at depressed temperatures. The working fluid then travels outside the building to an evaporator 31. The evaporator acts as a low temperature heat source, which serves to raise the temperature of the working fluid with heat supplied by ambient air.

Ambient air is driven past the evaporator by a fan 34 to heat the passing working fluid in the evaporator pipes 32. The working fluid passing through the evaporator 32 is returned entirely to the vapor state. The working fluid then returns by pipe 36 to the multipressure compressor 18.

The source of heat for the heat pump evaporator may be air, water, geologic masses, solar radiation or even waste heat, and the best choice depends upon location, prevailing climate and hot water output requirements. In the embodiment shown, ambient air is the heat source and is at 55°, a temperature which may be achieved in most areas of the United States for a large part of the year.

Figure 2:
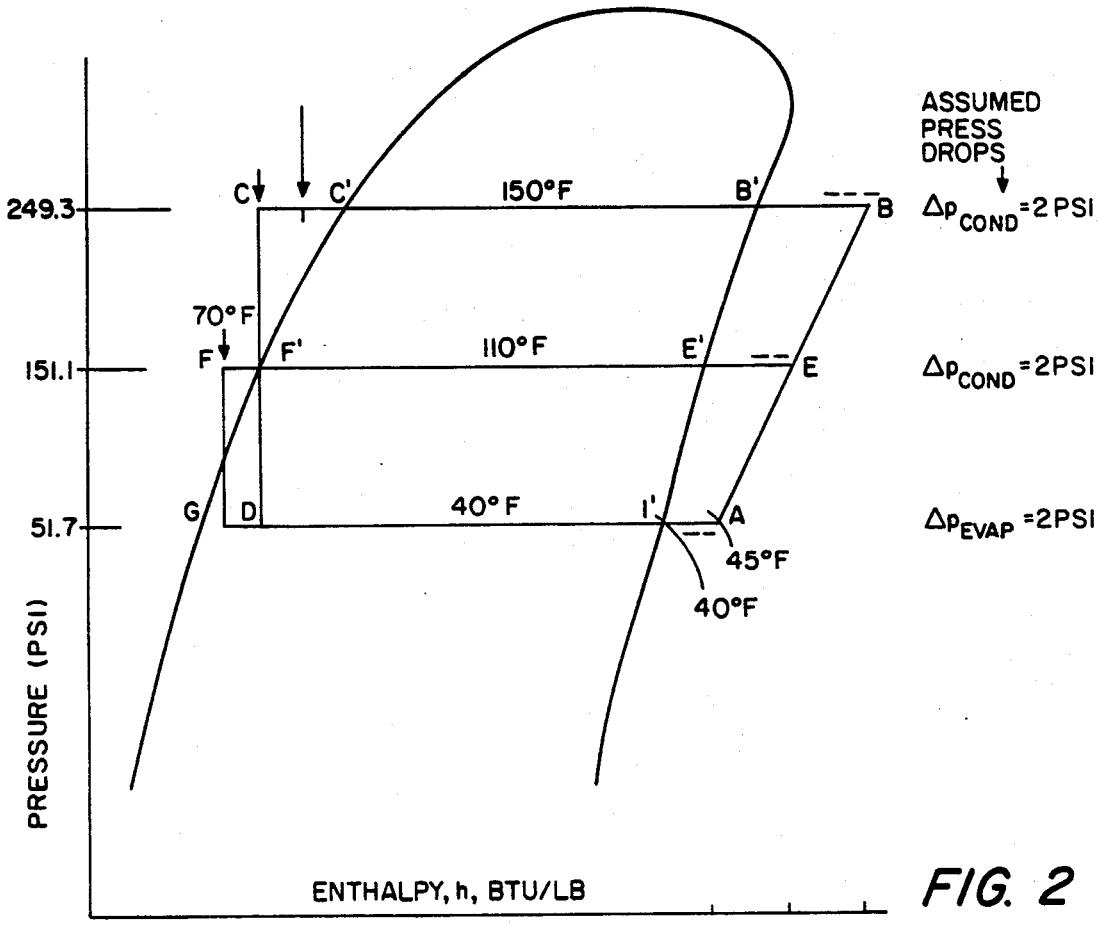
FIG. 2 is an enthalpy-pressure graph showing the various pressures and temperatures of the working fluid in the heat pump shown in FIG. 1.
Figure 3:
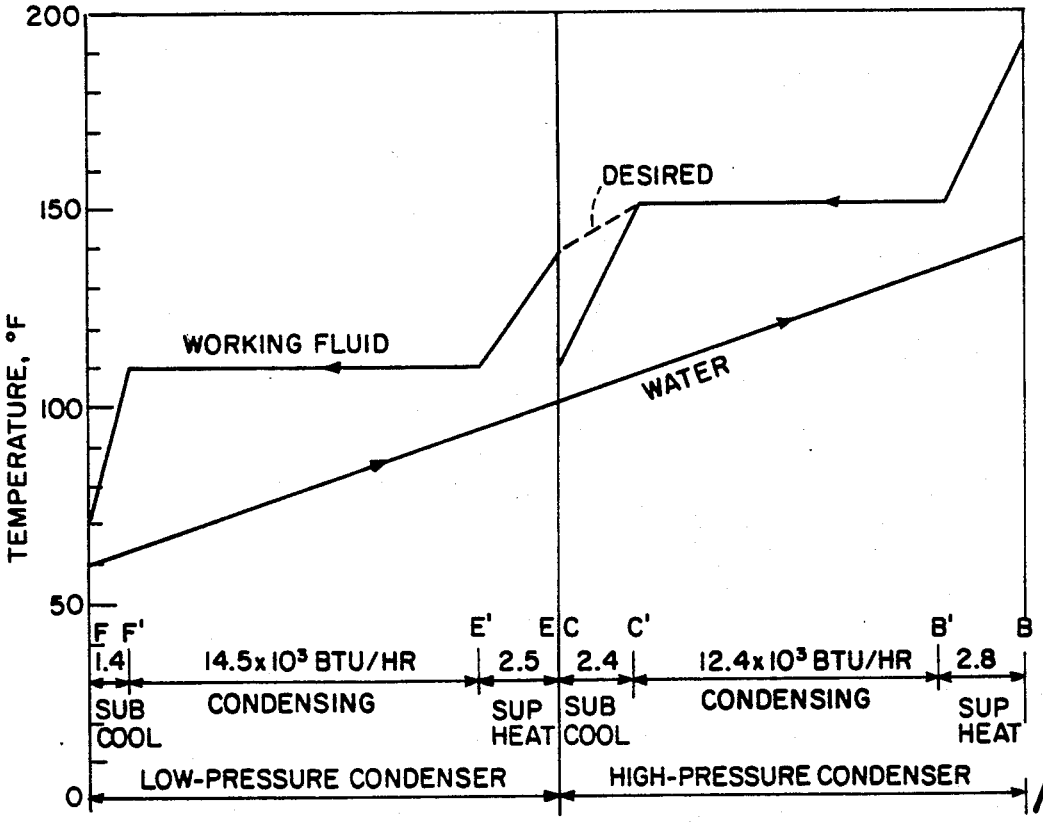
FIG. 3 is a temperature distribution diagram for the working fluid and the hot water of the multicoil condenser of FIG. 1.

The graphs in FIGS. 2 and 3 are helpful in understanding the heat pump system just described. FIG. 2 is an enthalpy-pressure diagram of the working fluid throughout the heat pump system, and FIG. 3 is a temperature distribution diagram for the multicoil condenser. Both FIGS. 2 and 3 should be viewed in conjunction with FIG. 1.

You will note that upon these graphs several of the letters are shown as primed (′). These signify the points at which the working fluid begins and completes a change of state. Moving from right to left across either graph from B′ to C′ and from E′ to F′, the working fluid is changing from a vapor to a liquid in a constant temperature process.

FIG. 2 shows the various pressures and temperatures through which the working fluid is driven as it goes through its cycle in the heat pump shown in FIG. 1. It also shows the physical state of the working fluid assuming a typical working fluid such as R-12. These working fluids are similar to the working fluids found in typical domestic refrigerators.

As the working fluid leaves the evaporator its condition is as found at point A on both FIG. 1 and FIG. 2. The fluid is a mildly superheated vapor at approximately 45° F. The vapor is then driven through the compressor. At intermediate pressure the compressor drives the fluid up to point E on all three Figures. At this point the working fluid is a moderately superheated vapor at about 151 psia. The portion of the working fluid which continues to the high pressure port 25, FIG. 1 is driven to the higher pressure, higher temperature state B on all three Figures. This is the highest pressure and temperature point of the fluid in this embodiment at roughly 249 psia and 192° F.

The superheated vapors change state as they pass through the condensers and give up their heat to the respective hot water jackets, thereby heating the hot water for domestic use. The low pressure condenser 12 condenses the fluid from a superheated vapor at point E to a cool or subcool liquid at point F which is at approximately 70° F. This is most clearly seen in FIG. 2. Referring now to FIG. 3 and moving to the left across FIG. 3 from point E , the working fluid very quickly gives up a small amount of energy while dropping 30° in temperature and leaving the superheated region to point E′. A much larger amount of heat is given up to the water as the vapor condenses with no pressure or temperature drop to point F′. A small additional amount of heat is given up by the liquid working fluid with a 40° F. drop in temperature in the subcool region which leaves the working fluid at point F. As can be seen from FIG. 3 most of the useful energy given up by the working fluid is during its change of state.

The water is warmed additionally in the high pressure condenser where a similar transition of the working fluid takes place at higher pressures and temperatures. In the high pressure condenser 14, the superheated vapor cools from point B to point C' to 150° F. As the working fluid moves from B' to C' it condenses, giving up its largest portion of energy to the water, and it then continues to give up a small amount of energy as a cooling liquid C' to C in FIGS. 2 and 3. By these means, as the water moves left to right across FIG. 3, the water reaches its final output temperature of 140° F.

From points C and F, the cooled working fluid is expanded in the capillary tubes 24 and 26 associated with respective condensers 14 and 12. The fluid thus drops to a low pressure and low temperature as shown at G and D of FIG. 2. By expanding the working fluid from the condensers independently, flow rates through the condensers are held to optimum levels. The working fluid is combined into a single line 28 only after expansion.

The working fluid is next conducted to the evaporator 31 where heat from the ambient air is added to the working fluid. The working fluid vaporizes and returns to point A as a slightly superheated vapor. A single evaporator minimizes both thermodynamic and structural complexities of the system and thus minimizes cost.

Referring again to FIG. 3 in conjunction with FIGS. 1 and 2, it can be seen that the working fluid, as it moves through the condensers, gives up energy to the water in a nonlinear fashion. This is due to the large amount of latent heat of vaporization released by the working fluid upon changing state from vapor to liquid at a constant pressure and temperature.

In the system described, the water is heated from 60° F. to 100° F. and from 100° F. to 140° F. as it moves through the two condensers. Unlike a single stage heat pump system, both condensers offer high efficiency as does the overall heat pump system itself. The high efficiency of the condensers results from a minimal temperature difference between the water and the working fluid in each condenser. The efficiency of a counterflow heat exchanger is best when the temperature gradient between the working fluid and the fluid to be heated is minimized. A single condenser would need a working fluid condensing at about 150° F. along a substantial length of that condenser. With a water temperature near 60° F., a temperature gradient of 90° F. would be experienced at that point. In the system described, the maximum temperature gradient between the working fluid and surrounding water is only 50° F. Thus, in this system, the low temperature heat exchanger operates at a much more efficient level.

In a single stage heat pump, all the working fluid would have to be compressed to a high pressure and temperature for the water to reach domestic hot water levels. A primary reason for increased efficiency in this system is that only a portion of the working fluid is compressed to high pressure and temperature. This results in a reduction of the energy required to run the compressor. Along the same vein, heat pump efficiency is inversely proportional to the temperature gradient between the evaporator and the condenser. In this system, only a relatively small portion of the working fluid need be raised to the higher temperature, and the efficiency of the heat pump is based in part on the small temperature gradient between the evaporator and the low pressure condenser. In a single condenser heat pump, all the working fluid must be raised to the higher temperature, and the efficiency is based only on the larger temperature gradient.

Heat pumps utilize low temperature heat sources to supply them with the energy needed for the heat of vaporization. This same energy is later released by the working fluid at a much higher pressure and temperature. As can be seen on FIG. 3 the largest amount of energy is both acquired and given off during a change of state. This energy is acquired from ambient air at low cost to the system. However, to give off that energy to the high temperature water, the working fluid must be raised to an even higher temperature and thus to an even higher energy level. The compressor supplies that added energy potential. Much of that added energy is retained by the working fluid during the constant enthalpy pressure drop in the evaporators.

The primary losses from the system occur at the compressor and the compressor must be driven by electrical or other forms of energy which must be purchased by the operator. The system is therefore most economical in using the low temperature heat source whether it be air or other sources, where the temperature, and thus the potential energy, of the working fluid is not raised substantially. Minimizing the amount that the working fluid must be compressed minimizes the amount of additional energy that must be delivered to the system to cover cycle energy losses and make the system operate.

In the conventional system, all the working fluid would have to be driven up to a temperature at least slightly above the water temperature in order for the working fluid to give up, during condensation, the energy that it acquired in the evaporator. That being the case, one would have to purchase the amount of energy needed to compress all of the working fluid from 45° and 51 psia to 150° and 249 psia. Because this system as disclosed uses two condensers, only part of the working fluid must be compressed to that high pressure, and the system thus saves a large amount of energy that would otherwise be required to run the compressor. The energy that was not acquired in the evaporator but which was acquired through the compressor is expensive, and with this invention that expensive energy is avoided to some extent.

In summary, the present system increases efficiency in two major respects. The condenser heat exchangers work more efficiently by having minimal temperature gradients between the working fluid and the water to be heated. In addition, the heat pump operates in a more efficient cycle by having minimal temperature gradients between one condenser and the evaporator, thus requiring a lesser energy input at the compressor section to raise the working fluid pressure and temperature.

Figure 4:
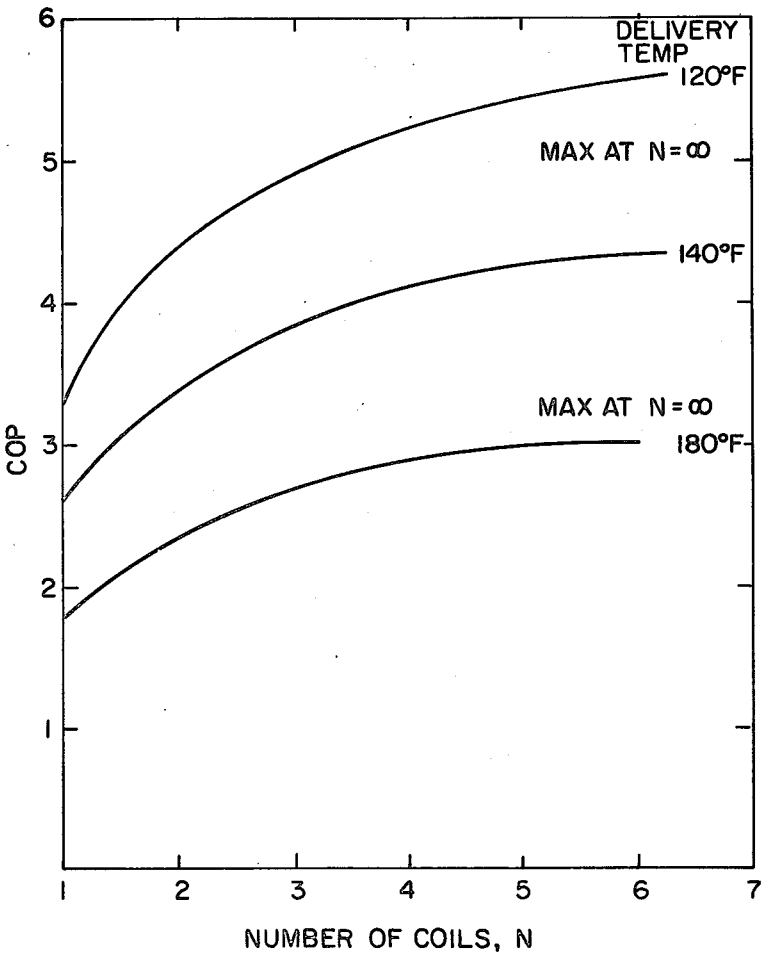
FIG. 4 is a graph of the coefficient of performance against the number of coils in the condenser of a hot water heating system for three temperatures of heated water.

The improved performance provided by multiple coils in the condenser can be seen graphically in FIG. 4. FIG. 4 is a graph of the coefficient of performance (COP) for various hot water delivery temperatures and numbers of condenser coil pressure levels. The COP is the ratio of useful heat output to the work input to the compressor and is calculated using assumptions based on conventional compressor efficiencies and the like. As indicated by FIG. 4, the largest percentage increase in performance results from the first few condenser coils. For example, at 140° F. delivery temperature, the addition of a second coil increases performance by 30%; the third coil increases performance by only 12% as compared to two coils; and the fourth coil increases performance by only 4% as compared to three coils.

Figure 5:
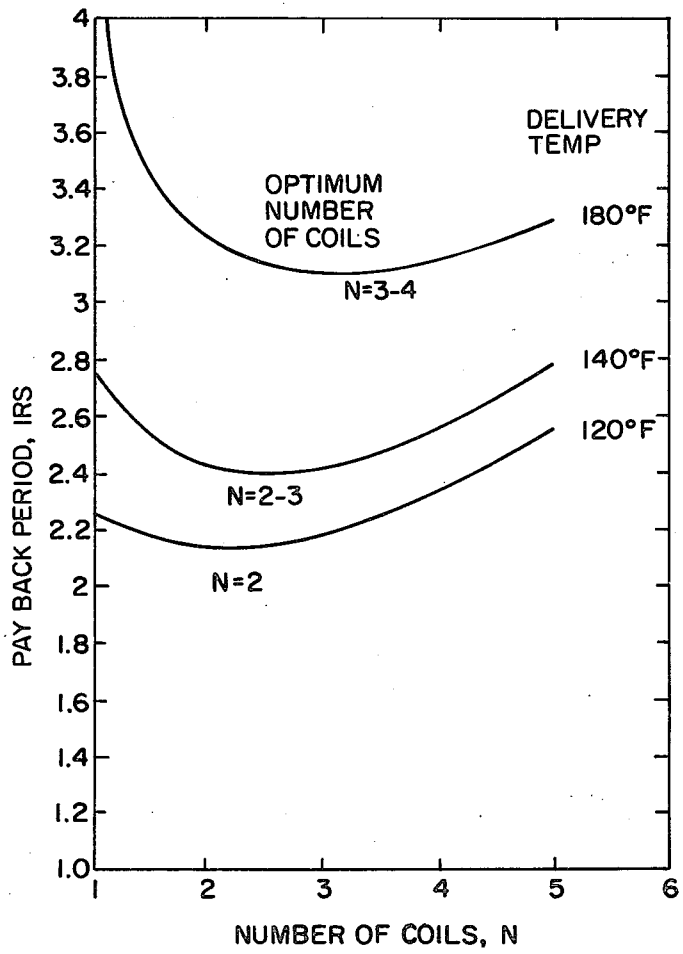
FIG. 5 is a graph of the payback period of multiple pressure heat pumps as a function of the number of coils in the condenser at the three temperature levels of FIG. 4.

The optimum number of coils for any given delivery temperature depends on economic factors including incremental costs associated with adding new pressure levels, costs of different energy forms, and duty cycle of the system. The payback periods of the heat pump shown in FIG. 5 are based on assumptions of a cost increase due to each additional coil of 16%, the cost of oil at $1.20 per gallon, the cost of electricity at $0.06 per kilowatt, and a duty cycle in which the system is off 70% of the time. The economic optimum number of coils provides a minimum payback period. From FIG. 5, the recommended number of coils for a 120° F. delivery temperature is two, the number of coils for a 140° F. delivery temperature is from two to three, and the number for a 180° F. delivery temperature is from three to four. Returning to FIG. 4, it can be seen that the optimum number of coils is that number which provides a COP of 60%–70% of the COP obtainable in an ideal cycle.

Although the system has been described primarily with respect to domestic hot water heating which requires a delivery temperature of about 140° F., FIG. 4 illustrates the great advantage of using such a multicoil heat pump system in very high temperature applications such as 180° F. It is generally stated that, due to economic considerations, the use of heat pumps as alternatives to other heating systems only becomes interesting when the COP of the heat pump system is greater than about 2.5. That COP is barely obtainable with a single condenser heat pump delivering at 140° F. and is not obtainable by such a system delivering at 180° F. However, with multiple condenser pressure levels, a COP of well above three can be obtained at 140° F. and a COP of over 2.5 is readily obtained at 180° F. using three or four condenser coils.

The first three figures, particularly FIG. 1, apply to an embodiment of the invention which is available as an add-on system to an existing hot water supply. In that system the heat pump utilizes the existing hot water tank from a conventional gas or oil system and no new building piping is required. The additions necessitated by this embodiment are only the compressor, water pump, and condensers indoors and the evaporator and electric fan outdoors.

Figure 6:
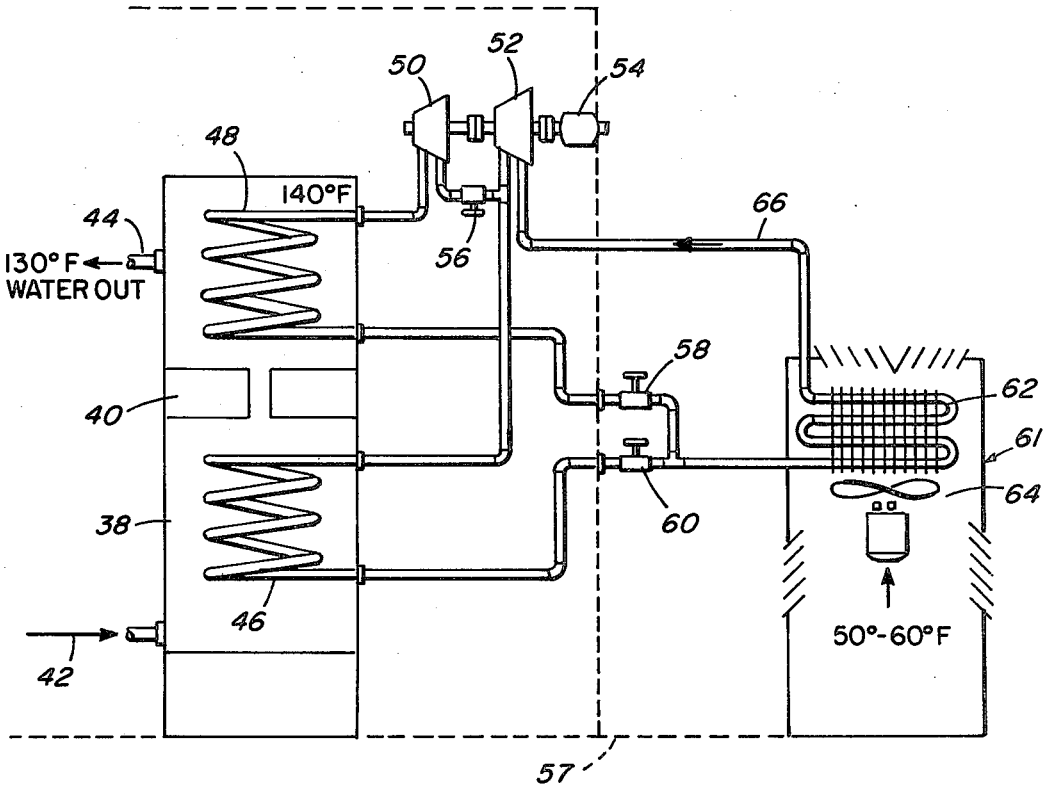
FIG. 6 is a schematic view of a heat pump for producing domestic hot water with multiple condensers immersed in a stratified hot water tank in an alternative embodiment of this invention.

An alternative embodiment is shown in FIG. 6. In this alternative embodiment of the invention, the heat pump hot water system would likely be original equipment in a new building or residence. Most components are equivalent to the components shown in FIG. 1. The significant difference in FIG. 6 is that high pressure and low pressure condensers 48 and 46 respectively, are immersed in the hot water storage tank 38. In addition, a physical barrier 40 results in enhanced stratification of the hot water in the tank. Enhanced stratification of the hot water tank minimizes the temperature gradient between the high pressure condenser and the surrounding water to raise the heat exchanger efficiency.

Water is supplied to the tank 38 by the cold water inlet 42 and is circulated by convection. Convection is the motion of fluids caused by varying temperatures and the natural flow of warm water to the top of the tank. This natural circulation causes the stratification of the hot water according to temperature. Hot water is withdrawn for use in taps or the like throughout the building through the hot water outlet 44 on the top of the tank.

The working fluid circulation is much the same as previously discussed in FIG. 1. Moderately pressurized working fluid leaves the low pressure compressor 52 and proceeds to the low pressure condenser 46. High pressure working fluid leaves the high pressure compressor 50 and moves through the high pressure condenser 48. The amount of high pressure versus low pressure working fluid is varied with valve 56 between the two compressors. Both compressors are driven by a single shaft electric motor 54. A single compressor as shown in FIG. 1 may also be used in this embodiment. The working fluid, upon leaving the condensers, is expanded to a common pressure by expander nozzles 58 and 60 equivalent to the capillary tubes of the previous embodiment. The working fluid then proceeds outside the building to the evaporator 61. Ambient air is blown by fan 64 through the coil 62 and the working fluid is vaporized and its temperature is raised somewhat. The working fluid leaves the evaporator along pipe 66 and returns to the compressor section.

While the invention has been particularly shown and described with reference to preferred embodiments thereof, it will be understood by those skilled in the art that various changes in form or details may be made therein without departing from the spirit and scope of the invention as described by the appended claims

I claim:

1. A heat pump system for heating a heat storage medium of the type in which a working fluid enters a compressor as a vapor at low pressure wherein the vaporized working fluid is compressed and thus heated, leaves the compressor and enters a heat exchanging condenser as a vapor at elevated pressure, there condenses as a result of heat transfer to the heat storage medium, the condensed working fluid enters an expander where the pressure and temperature decreases, the low pressure and temperature working fluid enters an evaporator where the working fluid is vaporized and returns to the compressor, the movement in combination therewith comprising:

a compressor means capable of compressing the working fluid to multiple distinct pressure levels;

multiple condensers operating at said multiple distinct pressure levels wherein said condensers and said heat storage medium are arranged with the higher pressure condenser in heat exchange relationship with a higher temperature region of said heat storage medium; and multiple expanders associated with said multiple condensers and with said evaporator, wherein said working fluid from said multiple condensers is expanded to a single low pressure and temperature before entering said evaporator, said working fluid vaporized in said evaporator.

2. The improvement in a heat pump system as claimed in claim 1 further comprising a means for enhancing the stratification by temperature of the heat storage medium.

3. The improvement in a heat pump system as claimed in claim 1 or 2 wherein said condensers are immersed in a heat storage medium tank.

4. The improvement in a heat pump system as claimed in claim 1 or 2 wherein the heat storage medium is circulated from a heat storage medium tank to the condensers and back to the heat storage medium tank.

5. The improvement in a heat pump system as claimed in claim 1 or 2 wherein the heat storage medium is domestic hot water and wherein there are two condensers.

6. A method for heating a heat storage medium utilizing a heat pump system using working fluid to transfer heat from the working fluid to the heat storage medium comprising in combination the steps of:

compressing said working fluid to a multiplicity of distinct pressure levels;

condensing said compressed working fluid compressed to a multiplicity of distinct pressure levels in a multiplicity of condensers in heat exchange relation with said heat storage medium wherein the condenser in fluid communication with the higher of said distinct pressure is arranged to be in heat exchange relationship with the higher temperature heat storage medium thereby efficiently transferring heat from said working fluid to said heat storage medium;

expanding independently in a multiplicity of expanders said condensed working fluid from said condensers to a single uniform low pressure; and the vaporizing in a single evaporator said low pressure working fluid said vaporizing resulting from heat transer from a low temperature heat source said vaporized low pressure working fluid being in fluid communication with said compressing step.

7. A method for heating a heat storage medium with a heat pump as claimed in claim 6 further comprising the steps of enhancing stratification by temperature of the heat storage medium.

8. A method for heating a heat storage medium with a heat pump as claimed in claim 6 or 7 further comprising the steps of recirculating the heat storage medium past condensers and through a heat storage tank.

9. A method for heating a heat storage medium with a heat pump as claimed in claim 7 or 8 wherein said compressing of said working fluid further comprises compressing all of the working fluid, removing a percentage of the fluid and further compressing the remainder of the fluid.

10. A method for heating a heat storage medium with a heat pump as claimed in claim 6 further comprising the steps of heating water as the heat storage medium to at least 140° F. and the working fluid is condensed in at least two condensers.

11. A method for heating a heat storage medium with a heat pump as claimed in claim 10 wherein said heated water is heated to at least 180° F. and the working fluid is condensed in at least three condensers.

12. A heat pump system for heating a heat storage medium comprising in combination a working fluid which is made to flow through multiple condensers which operate at multiple distinct pressure levels, wherein the multiplicity of distinct pressure levels is provided by multiple compressors, the condensers and the heat storage medium being arranged such that the higher pressure condenser is in heat exchange relationship with a higher temperature region of said heat storage medium, the working fluid from said condensers expanding independently in multiple expanders and the expanded working fluid made to flow through a single evaporator at a uniform pressure.

13. A heat pump system as claimed in claim 12 further comprising means for enhancing the stratification by temperature of the heat storage medium.

14. A heat pump system for heating a heat storage medium comprising in combination: a working fluid which is made to flow through multiple condensers which operate at multiple distinct pressure levels; the condensers and the heat storage medium being arranged such that the higher pressure condenser is in heat exchange relationship with a higher temperature region of said heat storage medium the working fluid from said condensers expanding independently in multiple expanders and the expanded working fluid made to flow through a single evaporator at a uniform pressure; and means for enhancing the stratification by temperature of the heat storage medium.

15. A heat pump system as claimed in claim 14 wherein the heat storage medium is water.

* * * * *